US009994356B2

(12) United States Patent
Couture

(10) Patent No.: US 9,994,356 B2
(45) Date of Patent: Jun. 12, 2018

(54) BLANKS AND METHODS FOR FORMING A SHELF-READY DISPLAY CONTAINER

(71) Applicant: WestRock Shared Services, LLC, Norcross, GA (US)

(72) Inventor: David G. Couture, Suwanee, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 290 days.

(21) Appl. No.: 15/071,874

(22) Filed: Mar. 16, 2016

(65) Prior Publication Data

US 2017/0267398 A1 Sep. 21, 2017

(51) Int. Cl.
*B65D 5/54* (2006.01)
*B65D 5/468* (2006.01)
(Continued)

(52) U.S. Cl.
CPC ..... *B65D 5/5445* (2013.01); *B31B 1/26* (2013.01); *B31B 1/62* (2013.01); *B31B 1/90* (2013.01); *B31B 3/26* (2013.01); *B31B 3/60* (2013.01); *B31B 3/74* (2013.01); *B65D 5/0227* (2013.01); *B65D 5/4608* (2013.01); *B31B 2201/26* (2013.01); *B31B 2201/6008* (2013.01); *B31B 2201/90* (2013.01); *B31B 2203/10* (2013.01)

(58) Field of Classification Search
CPC .... B31B 1/26; B31B 1/62; B31B 1/90; B31B 3/26; B31B 3/60; B31B 3/74; B65D 5/4608; B65D 2571/00796
USPC ..... 229/241, 164, 103, 120.011, 126, 147, 229/154, 172, 200, 235, 243; 206/736, 206/558, 746
See application file for complete search history.

(56) References Cited

U.S. PATENT DOCUMENTS 1,431,133 A 10/1922 Young
1,770,618 A 7/1930 Lambert
(Continued)

FOREIGN PATENT DOCUMENTS

DE 2116726 A 10/1972
DE 9005410 U1 7/1990
(Continued)

OTHER PUBLICATIONS

Delcor Cabrio Advertisment, apparently before Sep. 15, 2015. Downloaded Aug. 10, 2016 from http://www.delkorsystems.com/ameristar-award-winner.

*Primary Examiner* — Christopher Demeree
(74) *Attorney, Agent, or Firm* — WestRock IP Legal

(57) ABSTRACT

A blank of sheet material is provided for forming a container convertible from a shipping configuration to a display configuration. The blank includes a glue panel, a front panel, a top panel, a rear panel, and a bottom panel coupled together in series by a plurality of generally parallel fold lines. The glue panel includes an opening mechanism and is configured to couple in face-to-face relationship to the bottom panel when the container is formed. The blank also includes a pair of top side panels extending from opposing side edges of the top panel, and a pair of bottom side panels extending from opposing side edges of the bottom panel. An edge perforation line extends along an edge between the top panel and the rear panel, and a face of each of the top panel, the bottom panel, and the pairs of side panels is devoid of perforation lines extending therethrough.

21 Claims, 12 Drawing Sheets

(51) Int. Cl.

| | |
|---|---|
| ***B31B 1/26*** | (2006.01) |
| ***B31B 3/74*** | (2006.01) |
| ***B31B 1/90*** | (2006.01) |
| ***B31B 3/26*** | (2006.01) |
| ***B31B 3/60*** | (2006.01) |
| ***B65D 5/02*** | (2006.01) |
| ***B31B 1/62*** | (2006.01) |

(56) References Cited

U.S. PATENT DOCUMENTS

| | | | |
|---|---|---|---|
| 1,803,966 | A | 5/1931 | Gibbons |
| 1,916,045 | A | 6/1933 | Freymann |
| 1,925,102 | A | 9/1933 | Levkoff |
| 1,932,429 | A | 10/1933 | Wellman |
| 1,986,101 | A | 1/1935 | Brodsky |
| 2,074,229 | A | 3/1937 | Mckee |
| 2,343,222 | A | 2/1944 | Nelson |
| 2,426,911 | A | 9/1947 | Williamson |
| 2,540,595 | A | 2/1951 | Props |
| 2,675,913 | A | 4/1954 | Hanson |
| 2,706,593 | A | 4/1955 | Caraher |
| 2,762,550 | A | 9/1956 | Goettsch |
| 2,808,190 | A | 10/1957 | Buhrmaster |
| 2,836,338 | A | 5/1958 | Daniels |
| 2,964,169 | A | 12/1960 | Brachman |
| 3,007,622 | A | 11/1961 | George |
| 3,019,959 | A | 2/1962 | Skowronski |
| 3,029,008 | A | 4/1962 | Membrino |
| 3,043,490 | A | 7/1962 | Burnett |
| 3,055,573 | A | 9/1962 | Carter |
| 3,069,062 | A | 12/1962 | Keith |
| 3,111,255 | A | 11/1963 | Skowronski |
| 3,118,587 | A | 1/1964 | Welshenbach |
| 3,157,345 | A | 11/1964 | George |
| 3,167,179 | A | 1/1965 | Goldstein |
| 3,227,266 | A | 1/1966 | Soma |
| 3,228,582 | A | 1/1966 | Osberg |
| 3,235,166 | A | 2/1966 | Guyer |
| 3,245,527 | A | 4/1966 | Martin |
| 3,254,758 | A | 6/1966 | Guyer |
| 3,276,667 | A | 10/1966 | Johnson |
| 3,285,492 | A | 11/1966 | Demboske |
| 3,310,221 | A | 3/1967 | Duncan |
| 3,310,223 | A | 3/1967 | Buttery |
| 3,314,587 | A | 4/1967 | Johnson |
| 3,371,844 | A | 3/1968 | Perrella |
| 3,392,905 | A | 7/1968 | Caldwell |
| 3,428,234 | A | 2/1969 | DuBarry |
| 3,476,023 | A | 11/1969 | Fuller |
| 3,523,636 | A | 8/1970 | Phillips |
| 3,531,045 | A | 9/1970 | Johnson |
| 3,542,192 | A | 11/1970 | Steck |
| 3,543,998 | A | 12/1970 | Dunlap |
| 3,561,669 | A | 2/1971 | Postweiler |
| 3,568,911 | A | 3/1971 | Bebout |
| 3,606,969 | A | 9/1971 | Voytko |
| 3,640,190 | A | 2/1972 | Fuller |
| 3,643,856 | A | 2/1972 | Jones |
| 3,664,494 | A | 5/1972 | Mergens |
| 3,669,251 | A | 6/1972 | Phillips |
| 3,721,381 | A | 3/1973 | Locke |
| 3,730,417 | A | 5/1973 | Lawson |
| 3,744,702 | A | 7/1973 | Ellison |
| 3,815,808 | A | 6/1974 | Bunnell |
| 3,884,348 | A | 5/1975 | Ross |
| 3,893,614 | A | 7/1975 | Meyers |
| 3,910,482 | A | 10/1975 | Bamburg et al. |
| 3,910,483 | A | 10/1975 | Ritter |
| 3,917,158 | A | 11/1975 | Dorofachuk et al. |
| 3,926,362 | A | 12/1975 | Beck et al. |
| 3,927,761 | A | 12/1975 | Boyle |
| 3,935,798 | A | 2/1976 | Paxton |
| 3,942,631 | A | 3/1976 | Sutherland et al. |
| 3,955,671 | A | 5/1976 | Ockey |
| 3,955,743 | A | 5/1976 | Tanneberger |
| 3,960,312 | A | 6/1976 | Gorham |
| 3,961,706 | A | 6/1976 | Roccaforte et al. |
| 3,967,774 | A | 7/1976 | Querner |
| 4,000,811 | A | 1/1977 | Hardison et al. |
| 4,020,946 | A | 5/1977 | Gardner et al. |
| 4,058,206 | A | 11/1977 | Morse et al. |
| 4,103,819 | A | 8/1978 | Muise |
| 4,113,100 | A | 9/1978 | Soja et al. |
| 4,133,474 | A | 1/1979 | Hall |
| 4,174,803 | A | 11/1979 | Shrontz et al. |
| 4,184,625 | A | 1/1980 | Stollberg et al. |
| 4,196,843 | A | 4/1980 | Garmon |
| 4,211,322 | A | 7/1980 | Crescenzi et al. |
| 4,217,984 | A | 8/1980 | Magnuson |
| 4,350,281 | A | 9/1982 | Dornbusch et al. |
| 4,363,400 | A | 12/1982 | Lewis |
| 4,396,144 | A | 8/1983 | Gutierrez et al. |
| 4,429,826 | A | 2/1984 | Shedd |
| 4,483,095 | A | 11/1984 | Webinger |
| 4,553,666 | A | 11/1985 | Gullikson |
| 4,558,785 | A | 12/1985 | Gordon |
| 4,565,316 | A | 1/1986 | Jes |
| 4,641,746 | A | 2/1987 | Dornbusch et al. |
| 4,784,271 | A | 11/1988 | Wosaba et al. |
| 4,848,651 | A | 7/1989 | Hartness |
| 4,869,424 | A | 9/1989 | Wood |
| 4,871,067 | A | 10/1989 | Valenti |
| 4,886,160 | A | 12/1989 | Kligerman |
| 4,946,042 | A | 8/1990 | Ferreri et al. |
| 5,016,753 | A | 5/1991 | Henderson |
| 5,076,491 | A | 12/1991 | Freudentahl et al. |
| 5,098,757 | A | 3/1992 | Steel |
| 5,137,211 | A | 8/1992 | Summer et al. |
| 5,154,309 | A | 10/1992 | Wischusen et al. |
| 5,167,324 | A | 12/1992 | Miller |
| 5,181,650 | A | 1/1993 | Hollander et al. |
| 5,195,677 | A | 3/1993 | Quintana et al. |
| 5,201,868 | A | 4/1993 | Johnson |
| 5,288,012 | A | 2/1994 | Demay |
| 5,348,147 | A | 9/1994 | Gottfreid |
| 5,350,111 | A | 9/1994 | Vosbikian |
| 5,368,194 | A | 11/1994 | Oliff et al. |
| 5,413,276 | A | 5/1995 | Sheffer |
| 5,415,343 | A | 5/1995 | Vosbikian |
| 5,417,342 | A | 5/1995 | Hutchison |
| 5,465,831 | A | 11/1995 | Smith |
| 5,489,023 | A | 2/1996 | Havlovitz |
| 5,505,368 | A | 4/1996 | Kanter et al. |
| 5,505,369 | A | 4/1996 | Taliaferro |
| 5,505,371 | A | 4/1996 | O'neill |
| 5,507,430 | A | 4/1996 | Imhoff |
| 5,560,692 | A | 10/1996 | Smith |
| 5,582,345 | A | 12/1996 | Lankhuijzen |
| 5,590,788 | A | 1/1997 | Inman |
| 5,622,309 | A | 4/1997 | Matsuda et al. |
| 5,651,497 | A | 7/1997 | Ventura et al. |
| 5,657,872 | A | 8/1997 | Leftwich et al. |
| 5,690,213 | A | 11/1997 | Matsumura |
| 5,697,548 | A | 12/1997 | Halsell |
| 5,715,993 | A | 2/1998 | Pareike |
| 5,730,296 | A | 3/1998 | Limmer |
| 5,826,728 | A | 10/1998 | Sheffer |
| 5,842,576 | A | 12/1998 | Snow |
| 5,881,884 | A | 3/1999 | Podosek |
| 5,918,801 | A | 7/1999 | Milio |
| 5,950,914 | A | 9/1999 | Dunton et al. |
| 5,957,294 | A | 9/1999 | Kanter |
| 5,975,413 | A | 11/1999 | Moen |
| 5,979,749 | A | 11/1999 | Bozich |
| 6,073,833 | A | 6/2000 | Desrosiers et al. |
| 6,129,211 | A | 10/2000 | Prakken et al. |
| 6,158,579 | A | 12/2000 | Rosenbaum |
| 6,168,027 | B1 | 1/2001 | Esser |
| 6,189,778 | B1 | 2/2001 | Kanter |
| 6,189,780 | B1 | 2/2001 | Kanter |
| 6,209,786 | B1 | 4/2001 | Yelton et al. |
| 6,357,654 | B1 | 3/2002 | Gardner et al. |
| 6,371,365 | B1 | 4/2002 | Doucette et al. |
| 6,386,369 | B2 | 5/2002 | Yuhas et al. |

(56) References Cited

U.S. PATENT DOCUMENTS

| | | | | |
|---|---|---|---|---|
| 6,402,021 | B1 | 6/2002 | Heathcock | |
| 6,405,921 | B1 | 6/2002 | Cochrane | |
| 6,409,077 | B1 | 6/2002 | Telesca et al. | |
| 6,435,351 | B1 | 8/2002 | Gibb | |
| 6,457,637 | B1 | 10/2002 | Fritz et al. | |
| 6,478,159 | B1 | 11/2002 | Taylor et al. | |
| 6,510,982 | B2 | 1/2003 | White et al. | |
| 6,554,135 | B1 | 4/2003 | Luceri et al. | |
| 6,557,708 | B2 | 5/2003 | Polacco | |
| 6,729,475 | B2 | 5/2004 | Yuhas et al. | |
| 6,755,306 | B2 | 6/2004 | Maus | |
| 6,793,070 | B2 | 9/2004 | Dye | |
| 6,832,683 | B2 | 12/2004 | Boriani et al. | |
| D503,614 | S | 4/2005 | Sax et al. | |
| 6,918,487 | B2 | 7/2005 | Harrelson | |
| 6,932,265 | B2 | 8/2005 | Sax et al. | |
| 6,948,617 | B2 | 9/2005 | Kanter et al. | |
| 6,974,033 | B2 | 12/2005 | McLeod et al. | |
| 6,976,588 | B2 | 12/2005 | Wischusen et al. | |
| 6,981,632 | B2 * | 1/2006 | Gardner | B65D 5/541 229/103.3 |
| 6,986,456 | B2 | 1/2006 | Jone | |
| 7,066,321 | B2 | 6/2006 | Kawaguchi et al. | |
| 7,066,333 | B2 | 6/2006 | Justice | |
| 7,066,379 | B2 | 6/2006 | McLeod et al. | |
| 7,080,736 | B2 | 7/2006 | Jackson et al. | |
| 7,097,041 | B2 | 8/2006 | Marrale | |
| 7,104,435 | B2 | 9/2006 | Holley | |
| 7,175,066 | B2 | 2/2007 | Varanasi | |
| 7,213,707 | B2 | 5/2007 | Hubbs et al. | |
| 7,225,930 | B2 | 6/2007 | Ford et al. | |
| 7,237,674 | B2 | 7/2007 | Auclair | |
| 7,284,652 | B2 | 10/2007 | Zeitler et al. | |
| 7,284,662 | B2 | 10/2007 | Debusk et al. | |
| 7,331,508 | B2 | 2/2008 | Kanter et al. | |
| 7,373,765 | B2 | 5/2008 | Welchel et al. | |
| 7,377,385 | B2 | 5/2008 | Giannini et al. | |
| 7,401,711 | B2 | 7/2008 | Spivey | |
| 7,431,163 | B2 | 10/2008 | Andersen | |
| 7,451,878 | B2 | 11/2008 | Rochefort et al. | |
| 7,455,215 | B2 | 11/2008 | McLeod et al. | |
| 7,478,725 | B2 | 1/2009 | Holley | |
| 7,523,842 | B2 | 4/2009 | Spivey | |
| 7,568,611 | B2 | 8/2009 | Cargile | |
| 7,621,438 | B2 | 11/2009 | Spivey | |
| 7,628,746 | B2 | 12/2009 | Varanasi | |
| 7,703,666 | B2 | 4/2010 | Hand et al. | |
| 7,717,324 | B2 | 5/2010 | Keefe | |
| 7,743,921 | B2 | 6/2010 | Hubbs et al. | |
| 7,870,994 | B2 | 1/2011 | Spivey et al. | |
| 7,992,716 | B2 | 8/2011 | Jackson | |
| 8,011,567 | B2 | 9/2011 | Debusk et al. | |
| 8,028,839 | B2 | 10/2011 | Learn | |
| 8,061,587 | B2 | 11/2011 | Blin | |
| 8,281,981 | B2 * | 10/2012 | Foden | B65D 5/5445 206/746 |
| 8,342,335 | B2 | 1/2013 | Couture | |
| 8,376,141 | B2 | 2/2013 | Couture | |
| 8,413,879 | B2 * | 4/2013 | Bevier | B65D 5/744 206/45.21 |
| 8,596,460 | B2 | 12/2013 | Scatterday | |
| 8,789,703 | B2 | 7/2014 | Couture et al. | |
| 8,833,638 | B2 | 9/2014 | Pezzoli | |
| 9,061,791 | B2 * | 6/2015 | Cameron | B65D 5/5405 |
| 9,382,031 | B2 * | 7/2016 | Ward, Jr. | B65D 5/18 |
| 2002/0175106 | A1 | 11/2002 | Nemoto | |
| 2004/0074956 | A1 | 4/2004 | Sax et al. | |
| 2004/0084350 | A1 | 5/2004 | Kim | |
| 2004/0232038 | A1 | 11/2004 | Daniels | |
| 2004/0232039 | A1 | 11/2004 | Daniels | |
| 2005/0000853 | A1 | 1/2005 | Rochefort et al. | |
| 2005/0161496 | A1 | 7/2005 | McLeod et al. | |
| 2005/0184139 | A1 | 8/2005 | Gasior | |
| 2005/0263434 | A1 | 12/2005 | Tibbels | |
| 2006/0006096 | A1 | 1/2006 | Funk | |
| 2006/0054676 | A1 | 3/2006 | Wischusen | |
| 2006/0060643 | A1 | 3/2006 | Sheffer | |
| 2006/0261140 | A1 | 11/2006 | Holley | |
| 2006/0283927 | A1 | 12/2006 | Walsh et al. | |
| 2007/0131749 | A1 | 6/2007 | Coltri-Johnson et al. | |
| 2007/0221715 | A1 | 9/2007 | Tibbels et al. | |
| 2007/0278282 | A1 | 12/2007 | Jolley et al. | |
| 2008/0078691 | A1 | 4/2008 | Malik et al. | |
| 2008/0197182 | A1 | 8/2008 | Jackson | |
| 2008/0245650 | A1 | 10/2008 | Kramlich | |
| 2008/0245850 | A1 | 10/2008 | Spivey | |
| 2009/0014352 | A1 | 1/2009 | Foden | |
| 2010/0276333 | A1 | 11/2010 | Couture | |
| 2011/0049226 | A1 | 3/2011 | Moreau et al. | |
| 2011/0284621 | A1 | 11/2011 | Couture | |
| 2011/0284624 | A1 | 11/2011 | Debusk et al. | |
| 2012/0234724 | A1 | 9/2012 | James et al. | |
| 2013/0092596 | A1 | 4/2013 | Couture et al. | |
| 2015/0053587 | A1 | 2/2015 | Gessler et al. | |

FOREIGN PATENT DOCUMENTS

| | | | |
|---|---|---|---|
| DE | 9105890 | U1 | 8/1991 |
| DE | 9210565 | U1 | 11/1992 |
| DE | 4325431 | A1 | 2/1994 |
| EP | 0456896 | A1 | 11/1991 |
| FR | 2383838 | A1 | 10/1978 |
| GB | 1068191 | A | 5/1967 |
| WO | WO1995011165 | A1 | 4/1995 |

* cited by examiner

BLANKS AND METHODS FOR FORMING A SHELF-READY DISPLAY CONTAINER

BACKGROUND

The embodiments described herein relate generally to a blank for forming a container and, more particularly, to a blank for forming a convertible shipping container having a removable top portion and a tray portion, wherein the container is convertible into a display tray when the top portion is removed from the tray portion.

Containers fabricated from paperboard and/or corrugated paperboard material are often used to store and transport goods. Such containers are usually formed from blanks of sheet material that are folded along a plurality of preformed fold lines to form an erected corrugated container. At least some known blanks include a pair of side panels, a top panel, a bottom panel, a plurality of end panels, and, in some cases, a glue tab, connected by a plurality of fold lines. The panels are rotated to form end walls, side walls, a bottom wall, and a top wall of the container. To form at least some known containers, some of the panels are secured using an adhesive. Such known containers are formed using a machine and/or by hand.

At least some known containers that are used to transport and/or store products may be stacked one on the other when the products are being transported or stored. The side walls of the containers on the lower layers of the stack are configured to support a weight of the containers on the upper layers of the stack. In addition, at least some known containers include lines of weakness through at least one side wall to facilitate separating a top portion of the container from a display (or tray) portion of the container after arrival at a retail facility. However, the lines of weakness in the side walls may reduce the stacking strength, causing products within the lower container to support the weight of the upper layers. As such, the products within the containers may be damaged during transport and/or storage.

BRIEF DESCRIPTION

In one aspect, a blank of sheet material for forming a container convertible from a shipping configuration to a display configuration is provided. The blank includes a glue panel, a front panel, a top panel, a rear panel, and a bottom panel coupled together in series by a plurality of generally parallel fold lines. The glue panel includes an opening mechanism and is configured to couple in face-to-face relationship to the bottom panel when the container is formed. The blank also includes a pair of top side panels extending from opposing side edges of the top panel, and a pair of bottom side panels extending from opposing side edges of the bottom panel. An edge perforation line extends along an edge between the top panel and the rear panel, and a face of each of the top panel, the bottom panel, and the pairs of side panels is devoid of perforation lines extending therethrough.

In another aspect, a container convertible from a shipping configuration to a display configuration is provided. The container is formed from a blank. The container includes opposing front and rear walls, and opposing top and bottom walls perpendicular to the opposing front and rear walls. The bottom wall includes a glue panel adjacent the front wall. The glue panel includes an opening mechanism. The container also includes a pair of opposing side walls orthogonal to the front and rear walls and the top and bottom walls. Each of the side walls includes a top side panel emanating from the top wall and a bottom side panel emanating from the bottom wall. An edge perforation line extends along an edge between the top wall and the rear wall. A face of each of the top wall, the bottom wall, the top side panels, and the bottom side panels is devoid of perforation lines extending therethrough.

In yet another aspect, a method for forming a container convertible from a shipping configuration to a display configuration from a blank is provided. The method includes rotating a series of panels of the blank including a glue panel, a front panel, a top panel, a rear panel, and a bottom panel about a plurality of generally parallel fold lines, and coupling the glue panel in face-to-face relationship to the bottom panel, to form a front wall, a top wall, a rear wall, and a bottom wall of the container. The glue panel includes an opening mechanism. The method also includes rotating a pair of top side panels and a pair of bottom side panels into orthogonal relationship with the front wall, the top wall, the rear wall, and the bottom wall to form a pair of opposing side walls. The top side panels extend from opposing side edges of the top panel and the bottom side panels extend from opposing side edges of the bottom panel. An edge perforation line extends along an edge between the top panel and the rear panel. A face of each of the top panel, the bottom panel, and the pairs of side panels is devoid of perforation lines extending therethrough.

DETAILED DESCRIPTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The embodiments described herein provide a stackable, convertible shipping container formed from a blank, and a method for constructing the same. The blank is constructed from sheet material. The container may be constructed from sheet material using a machine and/or by hand. In one embodiment, the blank is fabricated from a corrugated cardboard material. The blank, however, may be fabricated using any suitable material, and therefore is not limited to a specific type of material. In alternative embodiments, the blank is fabricated using cardboard, plastic, fiberboard, paperboard, foamboard, corrugated paper, and/or any suitable material known to those skilled in the art and guided by the teachings herein provided.

In an example embodiment, the container and/or a blank includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In one embodiment, the container includes a shape that provides functionality, such as a shape that facilitates packaging a food item, a shape that facilitates transporting the container, and/or a shape that facilitates stacking and/or arrangement of a plurality of containers.

Further, different embodiments described herein can vary in size and/or dimensions although similar labels are used for each embodiment. For example, although a depth is labeled similarly throughout the description, each embodiment can have varying depths.

Figure 1:
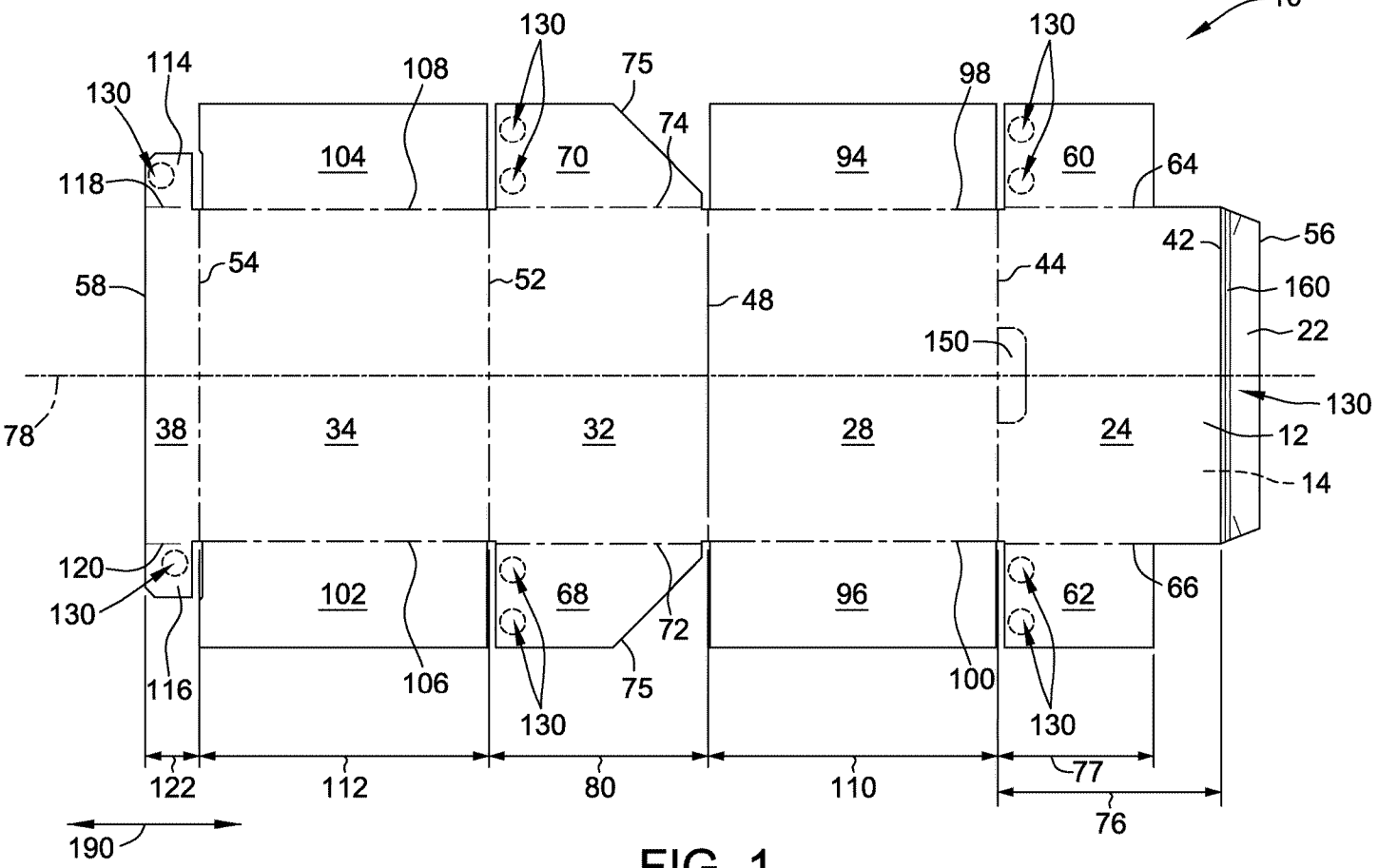
FIG. 1 is a top plan view of a first example embodiment of a blank of sheet material.
Figure 2A:
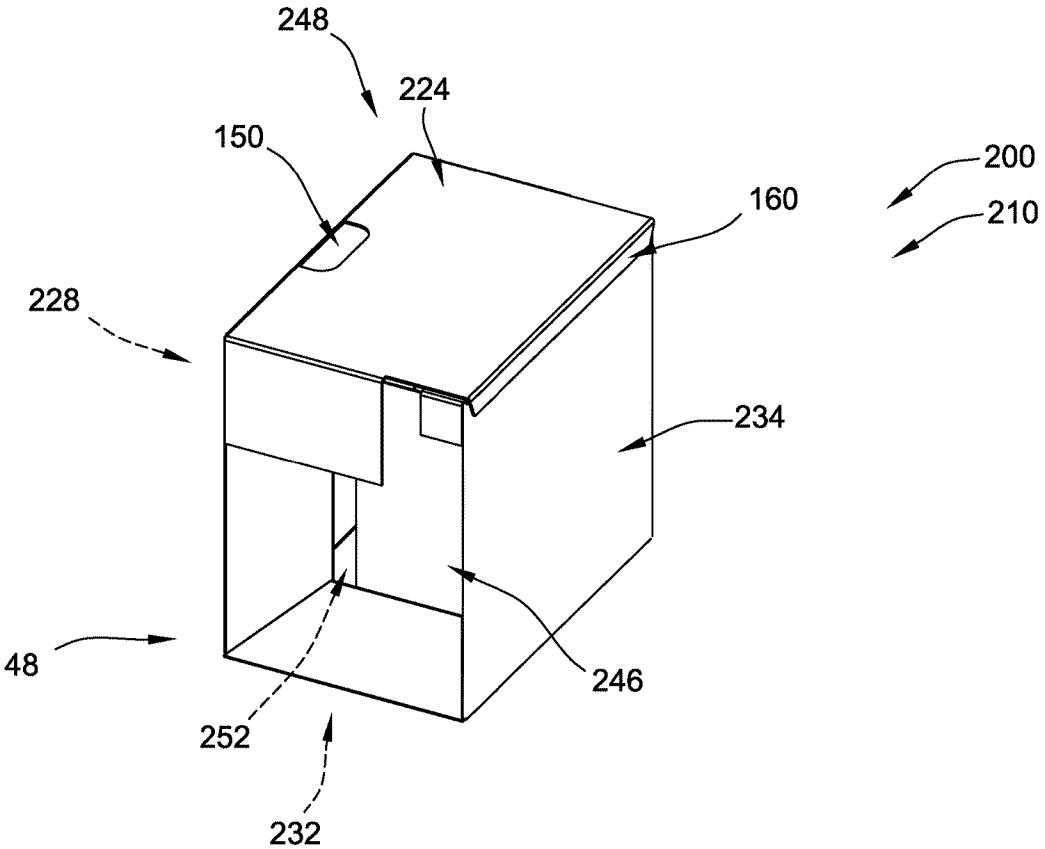
FIG. 2A is a perspective view of an example container formed from the blank shown in FIG. 1 in a closed, shipping configuration in a first orientation.
Figure 2B:
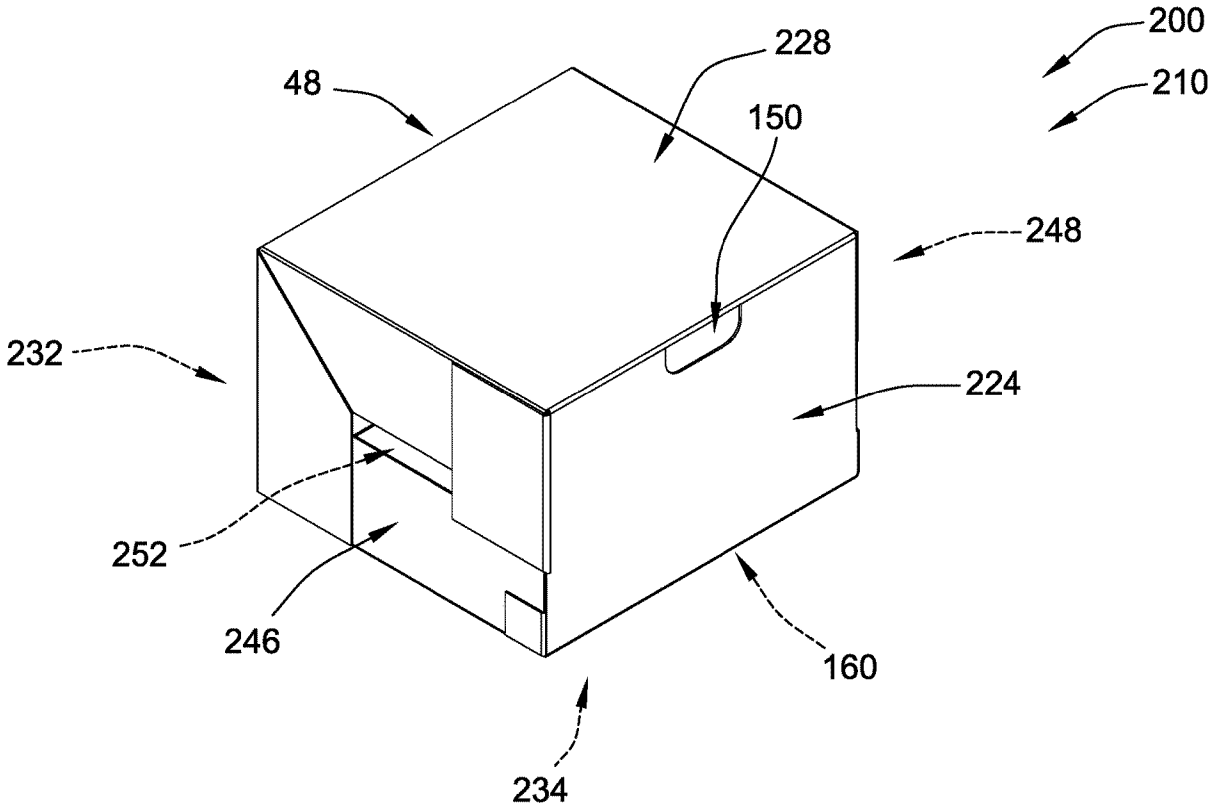
FIG. 2B is another perspective view of the container shown in FIG. 2A in a closed, shipping configuration in a second orientation.
Figure 3:
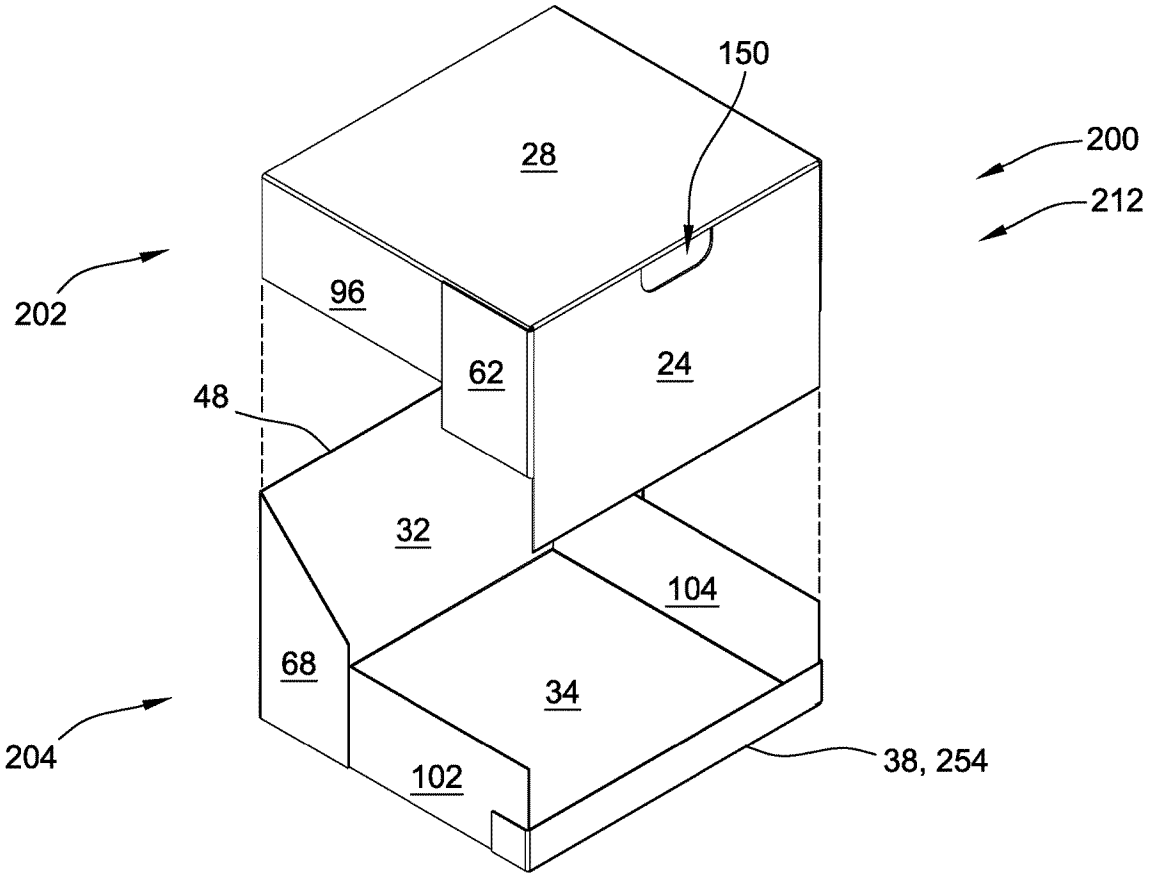
FIG. 3 is a perspective view of the container of FIG. 2 in the second orientation with a top portion removed, converting the container into a display configuration.

Referring now to the drawings, and more specifically to FIGS. 1-3, although as described above a container may have any suitable size, shape, and/or configuration, FIG. 1 is a top plan view of an example embodiment of a blank 10 of sheet material, FIG. 2A is a perspective view of a container 200 formed from blank 10 in a closed, shipping configuration 210 in a first orientation, FIG. 2B is another perspective view of container 200 in shipping configuration 210 in a second orientation, and FIG. 3 is a perspective view of container 200 in the second orientation with a top portion 202 removed from a tray portion 204 of container 200, converting container 200 into a display configuration 212.

As shown in FIG. 1, blank 10 has an exterior surface 12 and an interior surface 14. In certain embodiments, portions of exterior surface 12 and/or interior surface 14 of blank 10 include printed graphics, such as advertising and/or promotional materials. Blank 10 includes a series of aligned side panels and end panels connected together by a plurality of preformed, generally parallel, fold lines. Although referred to herein as side panels and end panels, the panels included in blank 10 that are used to form the side walls of the container may be collectively referred to as side panels or side faces.

Specifically the side panels include a glue panel 22, a first end panel 24, also referred to as a front panel 24, a top panel 28, a second end panel 32, also referred to as a rear panel 32, a bottom panel 34, and a retaining panel 38 connected in series along a plurality of fold lines 42, 44, 48, 52, and 54. It should be understood that designations such as "end," "side," "front," "rear," "top," and "bottom" are used for explanatory purposes only and do not impose orientation requirements on container 200 except as expressly stated herein. Glue panel 22 extends from a first free edge 56 of blank 10 to fold line 42, first end panel 24 extends from glue panel 22 along fold line 42, top panel 28 extends from first end panel 24 along fold line 44, second end panel 32 extends from top panel 28 along fold line 48, bottom panel 34 extends from second end panel 32 along fold line 52, and retaining panel 38 extends from bottom panel 34 along fold line 54 to a second free edge 58 of blank 10. Panels 24, 28, 32, and 34 may be referred to as first and second sets of opposing side panels, where panels 24 and 32 are one set and panels 28 and 34 are another set. In the example embodiment, fold line 48 is perforated to facilitate a user manually removing a top portion from a tray portion of a container constructed from blank 10, as described further herein. In alternative embodiments, any suitable separation mechanism is located along fold line 48 that enables a user to separate top panel 28 from second end panel 32. For example, but not by way of limitation, a pull strip or zipper rule is located along fold line 48.

In alternative embodiments, any plurality of fold lines may be perforated that enable blank 10 and a container constructed therefrom to function as described herein.

A first front side panel 60 and a second front side panel 62 extend from opposing side edges of first end panel 24. More specifically, first front side panel 60 and second front side panel 62 extend from first end panel 24 along a pair of opposing preformed, generally parallel, fold lines 64 and 66 respectively. Similarly, a first rear side panel 68 and a second rear side panel 70 extend from opposing side edges of second end panel 32. More specifically, first rear side panel 68 and second rear side panel 70 extend along a pair of opposing preformed, generally parallel, fold lines 72 and 74, respectively. Fold lines 64, 66, 72, and 74 are generally parallel to each other and generally perpendicular to fold lines 44, 48, and 52. Rear side panels 68 and 70 include notches 75 such that panels 68, 70 have an at least partially trapezoidal shape. In other embodiments, notches 75 are shaped such that panels 68 and 70 have any suitable shape, such as, but not limited to, rounded. In still other embodiments, panels 68 and 70 do not include notches 75. In the illustrated embodiment, first end panel 24 has a width 76 taken along a central horizontal axis 78 of blank 10 that is substantially equal to width 80, also taken along central horizontal axis 78 of blank 10. Front side panels 60 and 62 each have a width 77 taken along central horizontal axis 78 that is less than width 76. In alternative embodiments, each of panels 24, 60, and 62 has any width that enables blank 10 and a container constructed therefrom to function as described herein.

A first top side panel 94 and a second top side panel 96 extend from opposing side edges of top panel 28. More specifically, first side top panel 94 and second top side panel 96 extend from top panel 28 along a pair of opposing preformed, generally parallel, fold lines 98 and 100, respectively. Similarly, a first bottom side panel 102 and a second bottom side panel 104 extend from opposing side edges of bottom panel 34. More specifically, first bottom side panel 102 and second bottom side panel 104 extend from bottom panel 34 along a pair of opposing preformed, generally parallel, fold lines 106 and 108, respectively. Fold lines 98, 100, 106, and 108 are generally parallel to each other and generally perpendicular to fold lines 44, 48, 52, and 54. Top panel 28 has a width 110 taken along central horizontal axis 78 of blank 10 that is substantially equal to width 112 of bottom panel 34, also taken along central horizontal axis 78. Moreover, in the example embodiment, each of first top side panel 94 and second top side panel 96 has a width substantially equal to width 110 of top panel 28, and each of first bottom side panel 102 and second bottom side panel 104 has a width substantially equal to width 112 of bottom panel 34. In alternative embodiments, each of panels 28, 34, 94, 96, 102, and 104 has any width that enables blank 10 and a container constructed therefrom to function as described herein.

A first retaining panel tab 114 and a second retaining panel tab 116 extend from opposing side edges of retaining panel 38. More specifically, first retaining panel tab 114 and second retaining panel tab 116 extend from retaining panel 38 along a pair of opposing preformed, generally parallel, fold lines 118 and 120 respectively. Fold lines 118 and 120 are generally parallel to each other and generally perpendicular to fold line 54. In the illustrated embodiment, retaining panel 38 has a width 122 taken along central horizontal axis 78 of blank 10 that, when added to width 77 of first front side panel 60 or second front side panel 62, is less than or approximately equal to width 80 of second end panel 32 or width 76 of first end panel 24. In alternative embodiments, each of panels 38, 60, 62, and 24 has any width that enables blank 10 and a container constructed therefrom to function as described herein.

In the example embodiment, blank 10 includes a plurality of glue regions 130. Glue regions 130 are regions where glue or other adhesive is applied to strategically couple two or more of panels 24, 28, 32, 34, 60, 62, 68, 70, 94, 96, 102, and 104 when a container is formed from blank 10, as described further herein. In the example embodiment, glue regions 130 are included on panels 60, 62, 68, 70, 114, and 116. More specifically, glue regions 130 disposed on side panels 60 and 70 are configured to couple side panels 60 and 70 to side panels 94 and 104, respectively, and glue regions 130 disposed on side panels 62 and 68 are configured to couple side panels 62 and 68 to side panels 96 and 102, respectively. In alternative embodiments, glue regions 130 are included on any suitable panel that enables top portion 202 to be separated from tray portion 204 as described herein. For example, glue regions 130 are disposed on side panels 94 and 104 and are configured to couple side panels 60 and 70 to side panels 94 and 104, respectively. For another example, glue regions 130 are disposed on side panels 96 and 102 and are configured to couple side panels 62 and 68 to side panels 96 and 102, respectively.

In the example embodiment, first end panel 24 includes an access region 150 disposed adjacent to fold line 44. In the example embodiment, access region 150 is a region or area of weakness that can be punched-out by a user, leaving a cavity or hole in first end panel 24. In alternative embodiments, blank 10 includes access regions 150 in any suitable number, location, and configuration that enables blank 10 to function as described herein. For example, in alternative embodiments, blank 10 includes a plurality of access regions 150 disposed adjacent to one of fold lines 42, 44, 48, 52, and 54 on panels 24, 28, 32, and 34.

In certain embodiments, glue panel 22 includes an opening mechanism 160. Opening mechanism 160 enables a user to separate at least a portion of glue panel 22 from front panel 24. More specifically, after container 200 is formed and opening mechanism 160 is used, a portion of glue panel 22 remains adhered to panel 34, while exposing an edge of first end panel 24 proximate fold line 42. As described further herein, the exposed edge of panel 24 enables a user to separate top portion 202 and display, or tray, portion 204 of container 200 formed from blank 10.

For example, in the illustrated embodiment, opening mechanism 160 is an embedded pull strip, also referred to as a tear-away strip. The embedded pull strip includes a filament embedded in the blank material of panel 22. At least one end of the filament is accessible to a user, such that the filament can be pulled through the blank material to separate at least a portion of glue panel 22 from front panel 24. In some such embodiments, fold line 42 between glue panel 22 and front panel 24 is perforated to facilitate pulling the filament through the blank material along fold line 42. Alternatively, fold line 42 is not perforated. In alternative embodiments, opening mechanism 160 is any suitable mechanism that enables a user to separate at least a portion of glue panel 22 from front panel 24. For example, but not by way of limitation, opening mechanism 160 is a zipper rule or a perforation line.

In the example embodiment, blank 10 is fabricated from a corrugated cardboard material and includes a plurality of corrugations or flutes (not shown) therein, oriented parallel to a corrugation direction indicated at 190. As described further herein, corrugation direction 190 facilities improved stacking strength for blank 10 when erected into container 200.

Container 200 includes a first end wall 224, a top wall 228, a second end wall 232 opposite first end wall 224, a bottom wall 234 opposite top wall 228, a first side wall 246, and a second side wall 248 opposing first side wall 246. In the example embodiment, each of end walls 224 and 232 is generally perpendicular to each of side walls 246, 248, and each of end walls 224 and 232 and side walls 246, 248 is generally perpendicular to bottom wall 234 and top wall 228, such that container 200 has a generally rectangular shape. In alternative embodiments, end walls 224 and 232, side walls 246 and 248, top wall 228, and bottom wall 234 have any relative orientation that enables container 200 to function as described herein. In further alternative embodiments, container 200 has a generally square shape, or may have more than four side panels and/or side walls. End walls 224 and 232, side walls 246 and 248, top wall 228, and bottom wall 234 cooperate to define cavity 252 of container 200.

In some embodiments, blank 10 may be partially erected into container 200 in the first orientation, such that second end wall 232 defines a bottom of container 200, and filled with a product. The partially formed container 200 may then be sealed in shipping configuration 210 in the first orientation, as shown in FIG. 2A, such that second end wall 232 continues to define a bottom of container 200 for shipping and/or storage. After receipt at a retail facility, container 200 may be rotated 90 degrees into the second orientation, as shown in FIG. 2B, such that bottom wall 234 defines a bottom of container 200, and further converted into display configuration 212 in the second orientation as shown in FIG. 3 for placement on a shelf, where consumers can view and extract product for purchase directly from container 200. In some such embodiments, container 200 has an improved stacking strength in the first orientation, as will be described herein. In alternative embodiments, container 200 is placed in any suitable orientation for any of respectively filling the partially formed container with a product, storing the container, shipping the container, and displaying the display portion of the container.

In the example embodiment, first end wall 224 includes first end panel 24 and retaining panel 38, second end wall 232 includes second end panel 32, top wall 228 includes top panel 28, and bottom wall 234 includes bottom panel 34 and glue panel 22. Furthermore, first side wall 246 includes second front side panel 62, first rear side panel 68, second top side panel 96, first bottom side panel 102, and retaining panel tab 116. Further still, second side wall 248 includes first front side panel 60, second rear side panel 70, first top side panel 94, second bottom side panel 104, and retaining panel tab 114.

In the example embodiment, the following steps are performed to form container 200 in shipping configuration 210 from blank 10: (1) rotate glue panel 22, front panel 24, top panel 28, rear panel 32, bottom panel 34, and retaining panel 38 about parallel fold lines 42, 44, 48, 52, and 54, respectively, such that front panel 24 and rear panel 32 are substantially parallel to each other and substantially orthogonal to top panel 28 and bottom panel 34, and such that glue panel 22 is in substantially face-to-face relationship with bottom panel 34 and retaining panel 38 is in substantially face-to-face relationship with front panel 24, to form front wall 224, top wall 228, back wall 232, and bottom wall 234; (2) couple glue panel 22 to bottom panel 34 to form a manufacturing joint; (3) rotate side panels 60, 94, 70, and 104 into substantially orthogonal relationship to front wall 224, top wall 228, back wall 232, and bottom wall 234 to form side wall 248, such that side panel 60 aligns for coupling to side panel 94 and side panel 70 aligns for coupling to side panel 104 at a respective first region 130; and (4) rotate side panels 62, 96, 68, and 102 into substantially orthogonal relationship to front wall 224, top wall 228, back wall 232, and bottom wall 234 to form side wall 246, such that side panel 62 aligns for coupling to side panel 96 and side panel 68 aligns for coupling to side panel 102 at a respective second glue region 130. It should be understood that the steps listed above can be performed in any suitable sequence that enables container 200 to be formed from blank 10. Although container 200 may be secured together using any suitable fastener at any suitable location on container 200 without departing from the scope of the present disclosure, in certain embodiments, the manufacturing joint of step (2) is formed by applying adhesive to interior surface 14 of glue panel 22 and/or exterior surface 12 of bottom panel 34, and opening mechanism 160 is located on glue panel 22 such that opening mechanism 160 is accessible from exterior surface 12 of glue panel 22 on an outside of container 200.

In certain embodiments, as discussed above, container 200 in shipping configuration 210 is in the first orientation shown in FIG. 2A for shipping and/or storage, such that second end wall 232 defines a bottom of container 200 and first end wall 224 defines a top of container 200. In such an orientation, top panel 28, bottom panel 34, and side panels 94, 96, 102, and 104 each extend from the bottom to the top of container 200 and are oriented with corrugation direction 190 in a vertical direction, facilitating an improved stacking strength of container 200. In addition, in some such embodiments, side panels 94, 96, 102, and 104 are positioned interiorly with respect to side panels 60, 62, 68, and 70, such that side panels 94, 96, 102, and 104 are at least partially protected from external damage and are positioned to directly bear weight placed on the top of container 200 and transmit the weight directly to the bottom of container 200, again facilitating an improved stacking strength of container 200. Alternatively or additionally, although top portion 202 is easily removable as described herein, a face of each of top panel 28, bottom panel 34, and side panels 94, 96, 102, and 104 is devoid of perforation lines or other lines of weakness extending therethrough, further facilitating an improved stacking strength of container 200. In other words, to the extent any of top panel 28, bottom panel 34, and side panels 94, 96, 102, and 104 are associated with a perforation line, the perforation line extends at most along an end or side edge of any of top panel 28, bottom panel 34, and side panels 94, 96, 102, and 104, rather than into or through a face of top panel 28, bottom panel 34, and side panels 94, 96, 102, and 104. Moreover, in certain embodiments, front panel 24 and rear panel 32 also are devoid of perforation lines or other lines of weakness extending therethrough, further facilitating a stability of alignment of the walls of container 200 in shipping configuration 210 and, thus, an improved stacking strength of container 200. In alternative embodiments, at least one of top panel 28, bottom panel 34, and side panels 94, 96, 102, and 104 extends other than from the bottom to the top of container 200 and/or at least one of side panels 94, 96, 102, and 104 are positioned exteriorly with respect to side panels 60, 62, 68, and 70.

In the example embodiment, the following steps are performed to convert container 200 from shipping configuration 210 to display configuration 212: (1) operate opening mechanism 160 such that at least a portion of glue panel 22 remains adhered to bottom wall 234, while an edge of first end panel 24 defined proximate fold line 42 separates from bottom wall 234; and (2) pull top portion 202 up and back from display portion 204, for example by gripping access region 150, such that top wall 228 separates from back wall 232 along perforated fold line 48. As described above, side panels 94 and 96 emanate from top panel 28 and side panels 60 and 62 emanate from front panel 24 and are glued solely to side panels 94 and 96, respectively, such that side panels 60, 62, 94, and 96 separate from side walls 246 and 248 without interference. Panels 24, 28, 60, 62, 94, and 96 define removable top portion 202 of container 200. Similarly, side panels 102 and 104 emanate from bottom panel 34 and side panels 68 and 70 emanate from rear panel 32 and are glued solely to side panels 102 and 104, respectively, such that side panels 68, 70, 102, and 104 remain with bottom panel 34 and rear panel 32 to form display portion 204. In addition, retaining panel 38 forms a front display wall 254 of display portion 204, and retaining panel tabs 114 and 116 remain with display portion 204.

Figure 4:
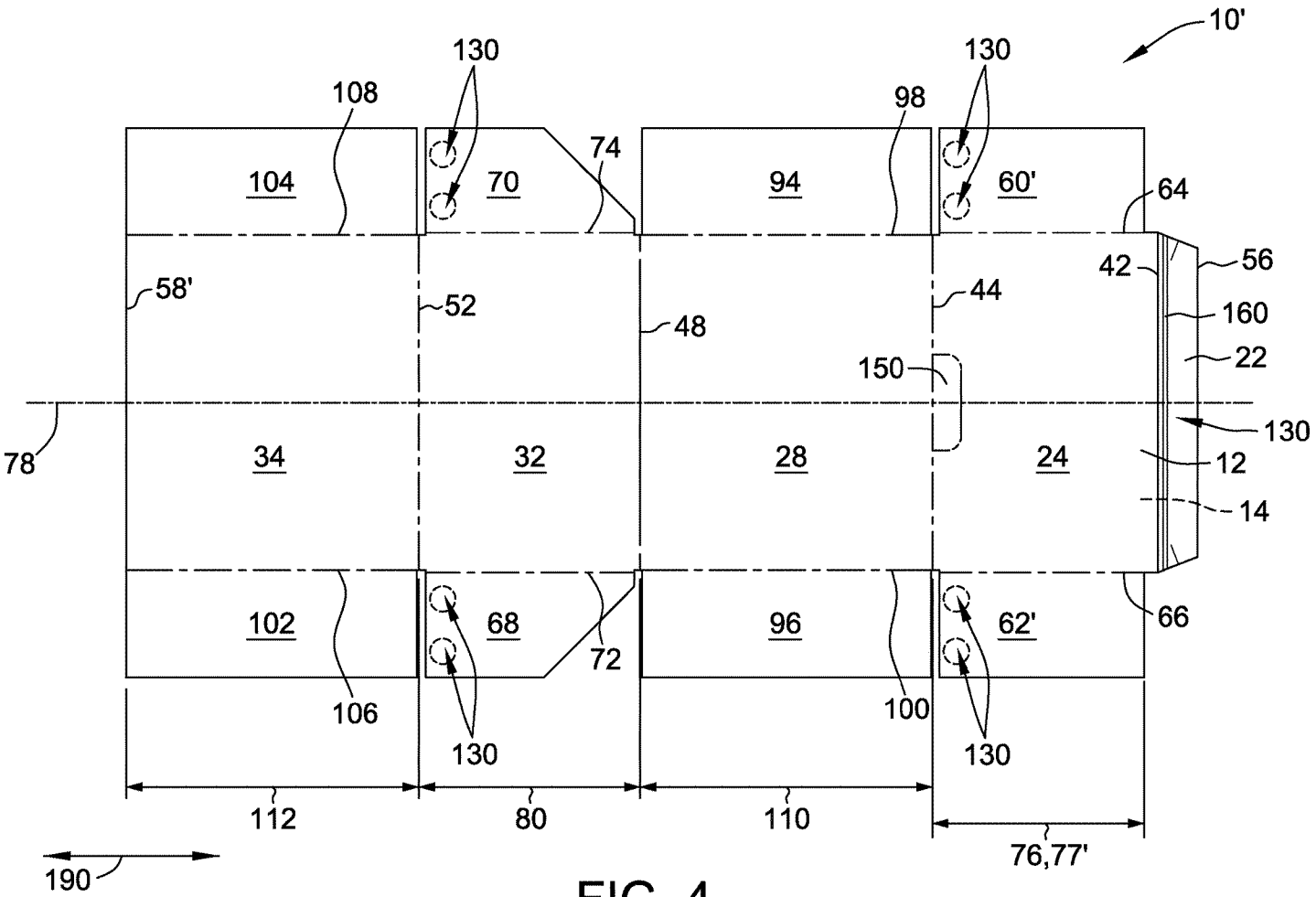
FIG. 4 is a top plan view of another example embodiment of a blank of sheet material.
Figure 5:
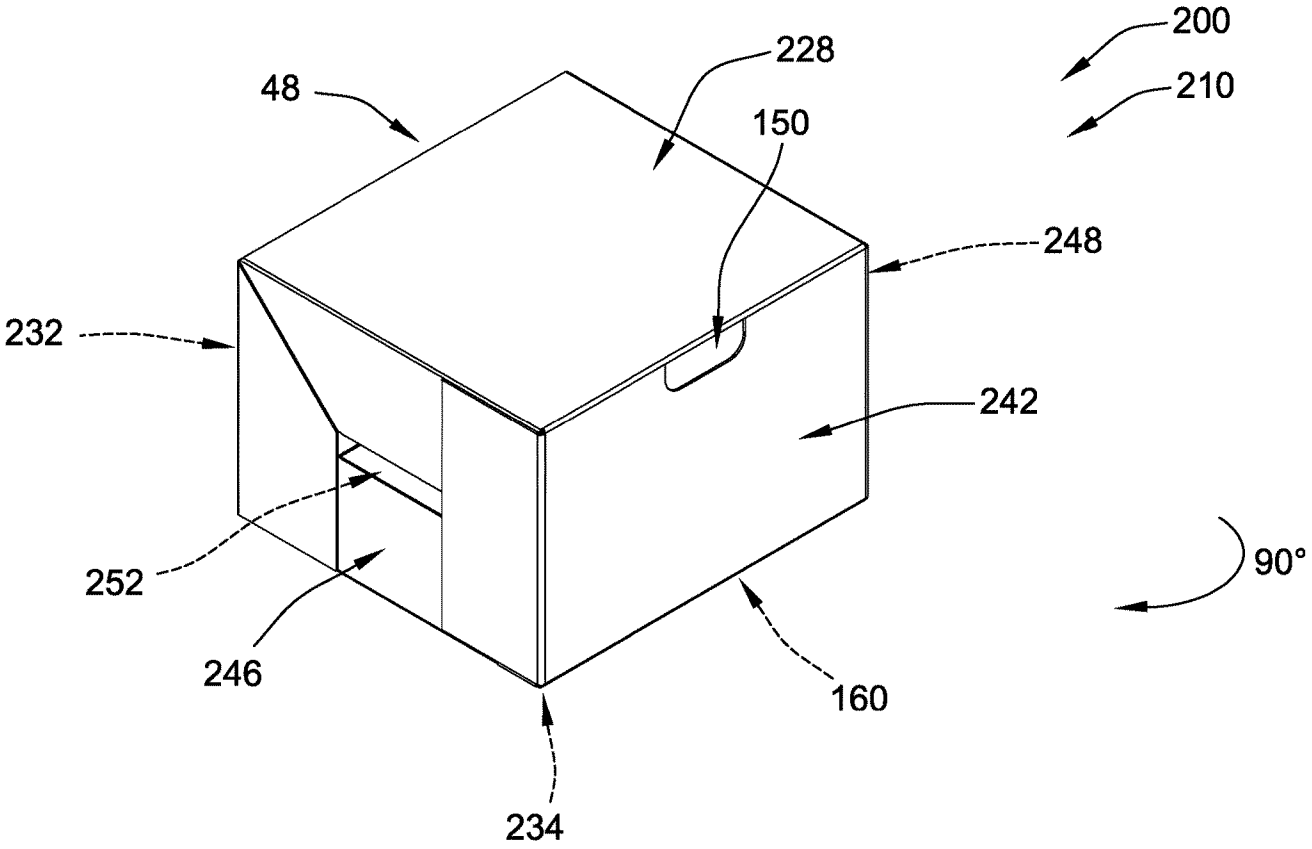
FIG. 5 is a perspective view of an example container formed from the blank shown in FIG. 4 in a closed, shipping configuration.
Figure 6:
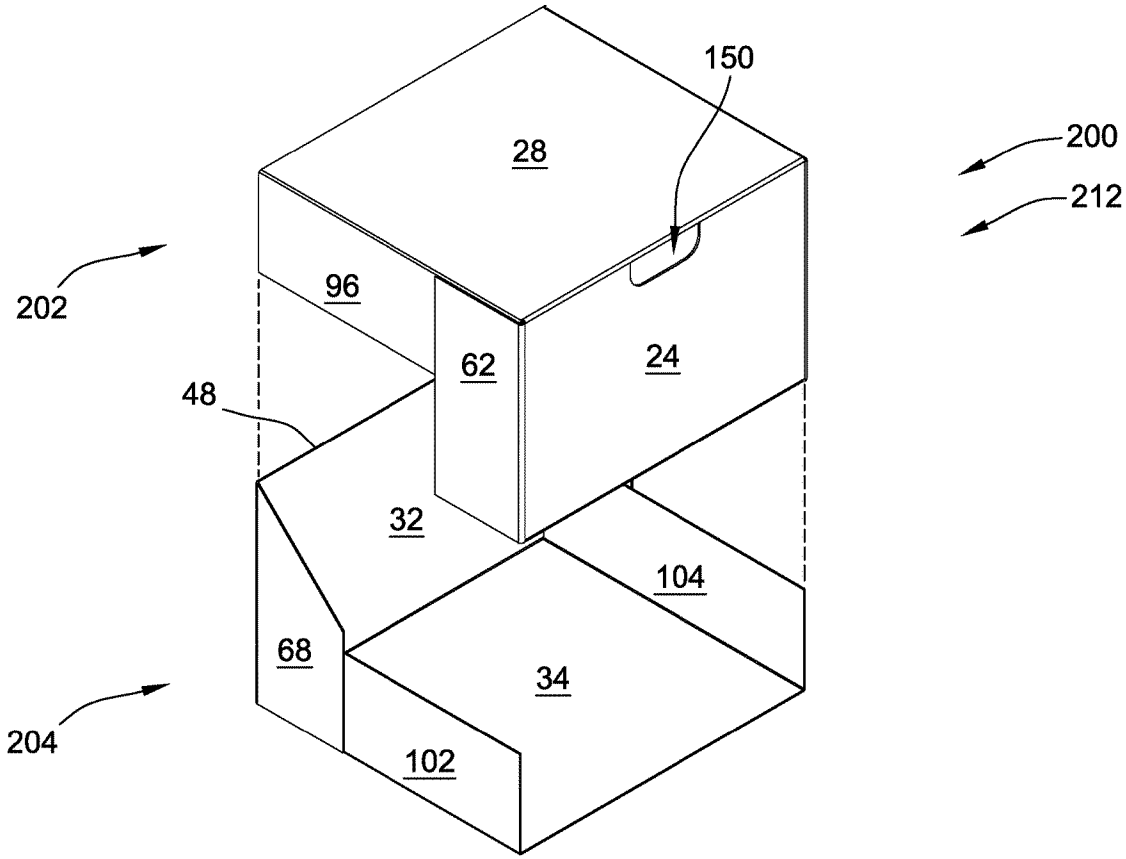
FIG. 6 is a perspective view of the container of FIG. 5 with a top portion removed, converting the container into a display configuration.

FIG. 4 is a top plan view of another example embodiment of a blank 10' of sheet material, FIG. 5 is a perspective view of a container 200' formed from blank 10 in a closed, shipping configuration 210 in the second orientation, and FIG. 6 is a perspective view of container 200' in the second orientation with top portion 202' removed from tray portion 204', converting container 200' into display configuration 212. More specifically, blank 10' is substantially similar to blank 10 (shown in FIG. 1) and container 200' is substantially similar to container 200 (shown in FIGS. 2 and 3), except as otherwise described herein.

More specifically, blank 10' does not include retaining panel 38, first retaining panel tab 114, and second retaining panel tab 116. Bottom panel 34, therefore, extends from second end panel 32 along fold line 52 to a free end 58'. Correspondingly, display portion 204' of container 200' does not include front display wall 254, facilitating easier access to products within display portion 204' in some embodiments. In addition, first front side panel 60' and second front side panel 62' each have a width 77' substantially equal to, or slightly less than, width 76 of front panel 24, comparatively wider than first front side panel 60 and second front side panel 62 of blank 10 (shown in FIG. 1). Correspondingly, when container 200' is in shipping configuration 210, side panels 60' and 62' facilitate improved enclosure of cavity 252 in certain embodiments.

Figure 7:
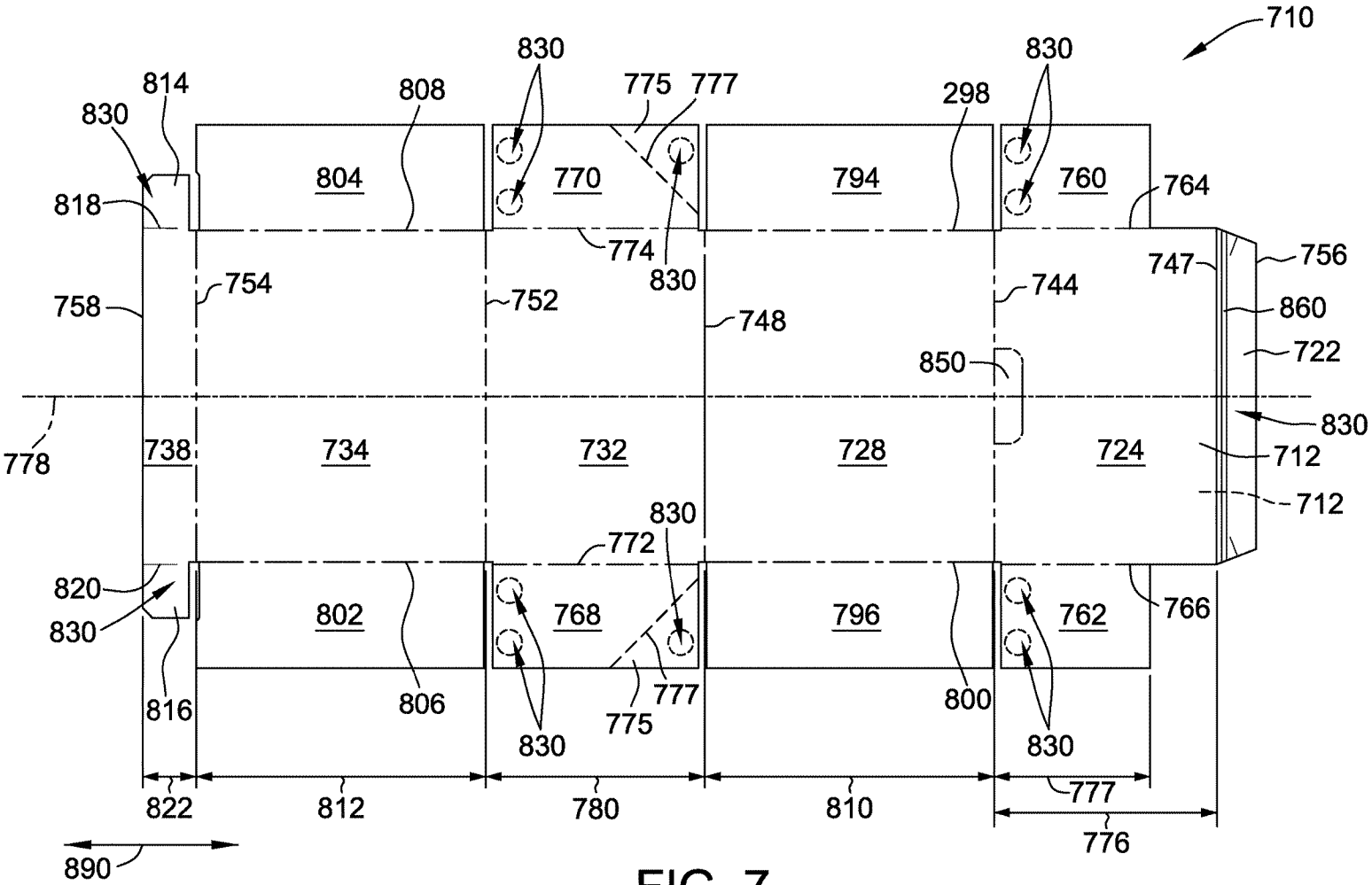
FIG. 7 is a top plan view of another example embodiment of a blank of sheet material.

FIG. 7 is a top plan view of another example embodiment of a blank 710 of sheet material. Blank 710 is substantially similar to blank 10 (shown in FIG. 1) and can be used to form a container (not shown) substantially similar to container 200 (shown in FIGS. 2 and 3), except as otherwise described herein. For example, blank 710 includes side panels including a glue panel 722, a first end panel 724, also referred to as a front panel 724, a top panel 728, a second end panel 732, also referred to as a rear panel 732, a bottom panel 734, and a retaining panel 738 connected in series along a plurality of fold lines 742, 744, 748, 752, and 754, similar to panels 22, 24, 28, 32, 34, and 38 of blank 10. In the example embodiment, fold line 748 is perforated to facilitate removing a top portion from a tray portion of the container constructed from blank 710, similar to fold line 48 of container 200 as described above. In alternative embodiments, any suitable separation mechanism is located along fold line 748 that enables a user to separate top panel 728 from second end panel 732.

In alternative embodiments, any plurality of fold lines may be perforated that enable blank 710 and a container constructed therefrom to function as described herein.

For example, blank 710 includes a corrugation direction 890 similar to corrugation direction 190, a first retaining panel tab 814 and a second retaining panel tab 816 extending from opposing side edges of retaining panel 738, an opening mechanism 860 similar to opening mechanism 160, and an access region 850 similar to access region 150 of blank 10. In some embodiments, fold line 742 between glue panel 722 and front panel 724 is perforated to facilitate pulling a filament of opening mechanism 860 through the blank material along fold line 742, as described above for fold line 42 of blank 10. Blank 710 further includes a first top side panel 794 and a second top side panel 796 extending from top panel 728 along a pair of opposing preformed, generally parallel, fold lines 798 and 800, respectively, and a second bottom side panel 802 and a second top side panel 804 extending from bottom panel 734 along a pair of opposing preformed, generally parallel, fold lines 806 and 808, respectively, similar to side panels 94, 96, 102, and 104 of blank 10. Additionally, blank 710 includes a first front side panel 760 and a second front side panel 762 extending from first end panel 724 along a pair of opposing preformed, generally parallel, fold lines 764 and 766, respectively, and a first rear side panel 768 and a second rear side panel 770 extending from second end panel 732 along a pair of opposing preformed, generally parallel, fold lines 772 and 774, respectively, similar to side panels 60, 62, 68, and 70 of blank 10. However, unlike blank 10, first rear side panel 768 and second rear side panel 770 each include a triangular-shaped removable region 775. Each removable region 775 can be separated from the remainder of panels 768, 770 long a respective rear side perforation line 777. For example, removable region 775 is separated from the remainder of panels 768, 770 after a container is constructed from blank 710.

In the example embodiment, blank 710 includes a plurality of glue regions 830 located similarly to glue regions 130 of blank 10, plus additional glue regions located on removable portions 775. Thus, when blank 710 is formed into a container, in contrast to container 200 (shown in FIGS. 2 and 3), side panels 768 and 770 are glued not only to side panels 802 and 804, respectively, but also to side panels 796 and 794, respectively, at portions 775. When the top portion of the container is removed from the display portion of the container to form a display configuration similar to display configuration 212, portions 775 separate along perforation lines 777 such that portions 775 are removed with the top portion, and a remainder of side panels 768 and 770 remain with bottom panel 734 and rear panel 732 to form the display portion. In some embodiments, side panels 768 and 770 having portions 775 coupled to side panels 796 and 794 facilitates at least one of forming the container in the shipping configuration by a high-speed machine, improved enclosure of the cavity, and/or improved stability of the container in the shipping configuration.

Figure 8:
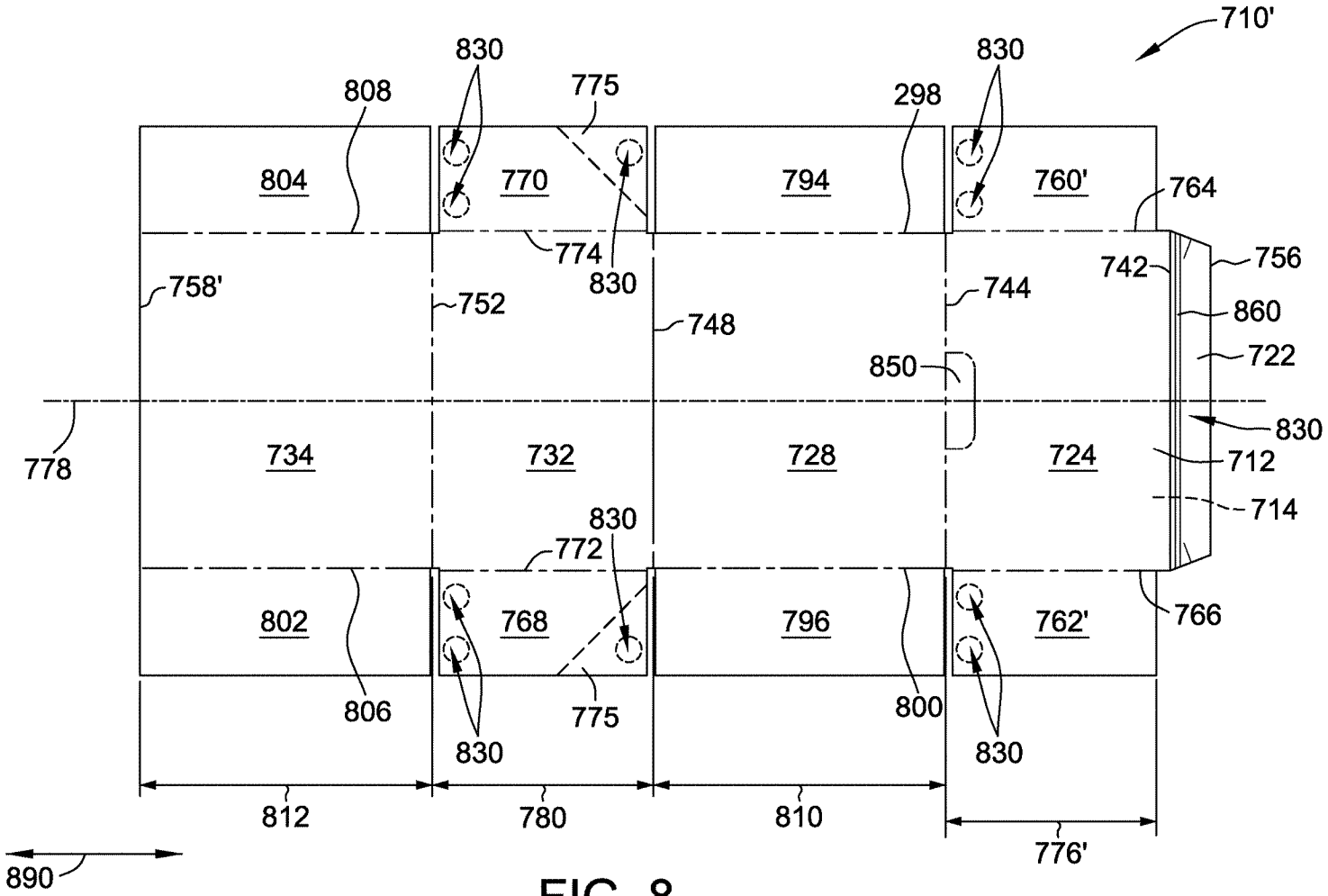
FIG. 8 is a top plan view of another example embodiment of a blank of sheet material.

FIG. 8 is a top plan view of another example embodiment of a blank 700' of sheet material. More specifically, blank 700' is substantially similar to blank 700 (shown in FIG. 7) and can be used to form a container (not shown) substantially similar to container 200 (shown in FIGS. 2 and 3), except as otherwise described herein.

More specifically, blank 700' does not include retaining panel 738, first retaining panel tab 814, and second retaining panel tab 816. Bottom panel 734, therefore, extends from second end panel 732 along fold line 752 to a free end 758'. Correspondingly, the display portion of the formed container does not include front display wall 254 (shown in FIG. 3), facilitating easier access to products within the display portion in some embodiments. In addition, first front side panel 760' and second front side panel 762' each have a width 777' substantially equal to, or slightly less than, width 776 of front panel 724, comparatively wider than first front side panel 760 and second front side panel 762 of blank 710 (shown in FIG. 7). Correspondingly, when the formed container is in the shipping configuration, side panels 760' and 762' facilitate improved enclosure of the container cavity in certain embodiments.

Figure 9:
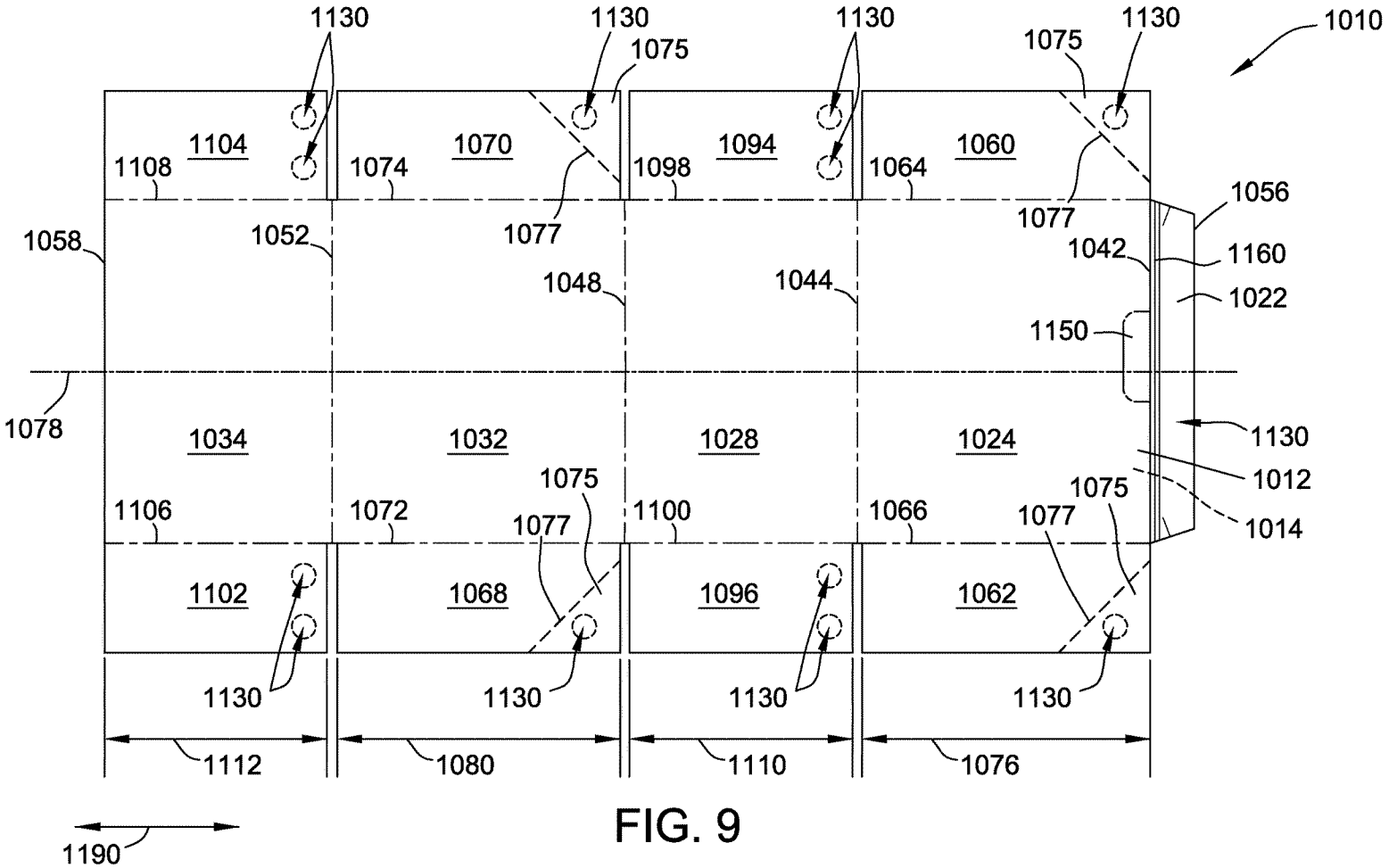
FIG. 9 is a top plan view of another example embodiment of a blank of sheet material.
Figure 10:
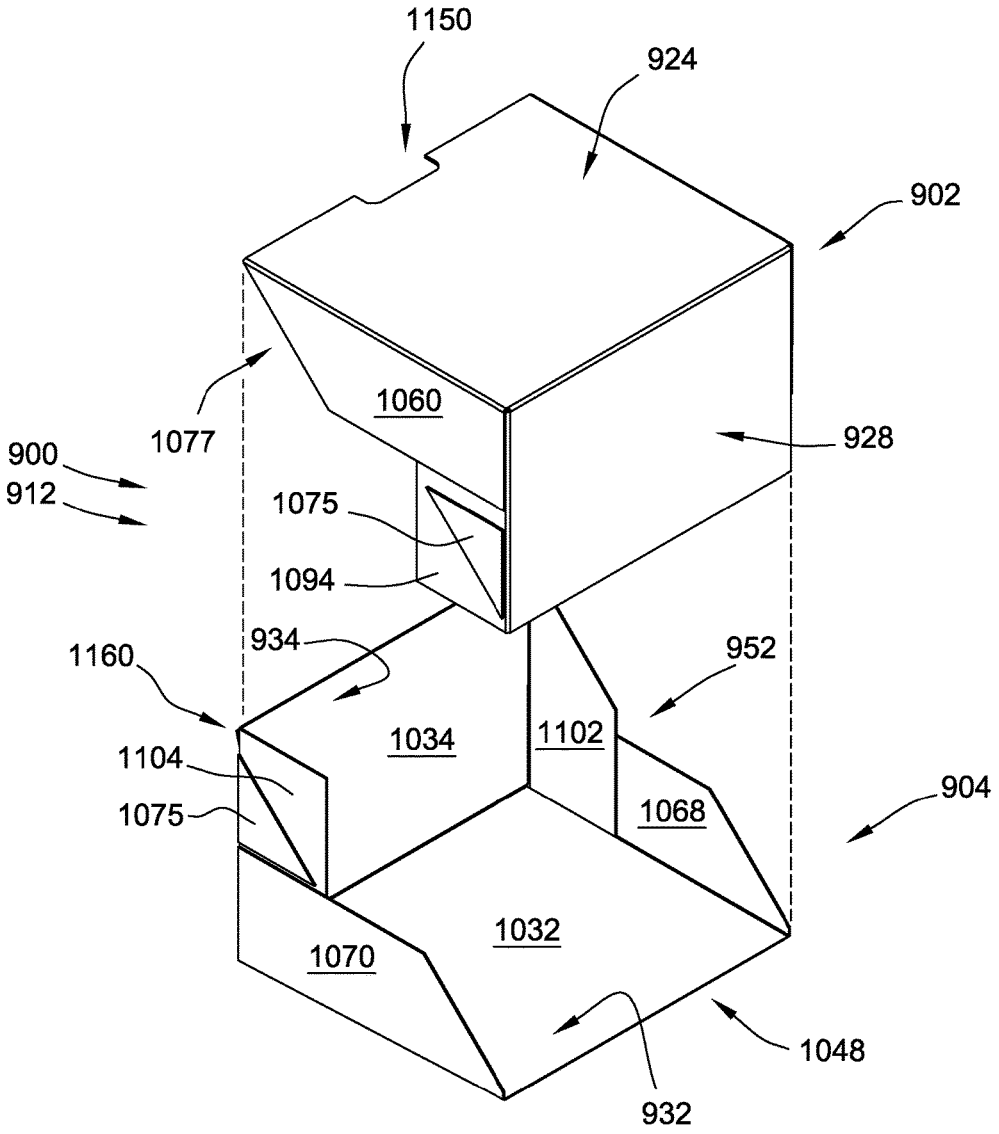
FIG. 10 is a perspective view of an example container formed from the blank shown in FIG. 9 with a top portion removed, converting the container into a display configuration.

FIG. 9 is a top plan view of another example embodiment of a blank 1010 of sheet material. FIG. 10 is a perspective view of a container 900 formed from blank 1010 with a top portion 902 removed from a tray portion 904, converting container 900 into a display configuration 912. Container 900 is initially formed in a shipping configuration (not shown) similar to shipping configuration 210 of container 200 (shown in FIG. 2). Blank 1010 is substantially similar to blank 710' (shown in FIG. 8), except as otherwise described herein. For example, blank 1010 includes side panels including glue panel 1022, first end panel 1024, also referred to as a front panel 1024, a top panel 1028, a second end panel 1032, also referred to as rear panel 1032, and a bottom panel 1034 connected in series along a plurality of fold lines 1042, 1044, 1048, and 1052 similar to panels 722, 724, 728, 732, and 734 of blank 710'. In the example embodiment, fold line 1048 is perforated or otherwise separable, similar to fold line 748 of blank 710' as described above, and glue panel 1022 includes an opening mechanism 1160, similar to opening mechanism 860 of glue panel 722, to facilitate removing top portion 902 from tray portion 904, similar to as described with respect to container 200. In some such embodiments, fold line 1042 between glue panel 1022 and front panel 1024 is perforated to facilitate pulling a filament of opening mechanism 1160 through the blank material along fold line 1042, as described above for fold line 42 of blank 10. In alternative embodiments, any plurality of fold lines may be perforated that enable blank 1010 and a container constructed therefrom to function as described herein.

Blank 1010 includes a corrugation direction 1190 similar to corrugation direction 190. Blank 1010 further includes a first top side panel 1094 and a second top side panel 1096 extending from top panel 1028 along a pair of opposing preformed, generally parallel, fold lines 1098 and 1100, respectively, and a first bottom side panel 1102 and a second bottom side panel 1104 extending from bottom panel 1034 along a pair of opposing preformed generally parallel fold lines 1106 and 1108, similar to side panels 794, 792, 802, and 804 of blank 710'. Additionally, blank 1010 includes a first front side panel 1060 and a second front side panel 1062 extending from first end panel 1024 along a pair of opposing preformed, generally parallel, fold lines 1064 and 1066, respectively, and a first rear side panel 1068 and a second rear side panel 1070 extending from a second end panel 1032 along a pair of opposing preformed, generally parallel, fold lines 1072 and 1074, respectively, similar to side panels 760', 762', 768, and 770 of blank 710'.

In addition, triangular-shaped removable regions 1075 of blank 1010, having glue regions 1130 disposed thereon, are included on first rear side panel 1068 and second rear side panel 1070, similar to triangular-shaped removable regions 775 on first rear side panel 768 and second rear side panel 770 of blank 710'. However, unlike blank 710', blank 1010 further includes triangular-shaped removable regions 1075, having glue regions 1130 disposed thereon, on first front side panel 1060 and second front side panel 1062. Also unlike blank 710', access region 1150 on blank 1010 is positioned on front panel 1024 adjacent fold line 1042, rather than adjacent fold line 1044. In alternative embodiments, blank 1010 includes access regions 1150 in any suitable number, location, and configuration that enables blank 1010 to function as described herein.

Container 900 includes a first end wall 924, a top wall 928, a second end wall 932 opposite first end wall 924, and a bottom wall 934 opposite top wall 928 similar to walls 224, 228, 232, and 234 of container 200. In the example embodiment, first end wall 924 includes first end panel 1024, second end wall 932 includes second end panel 1032, top wall 928 includes top panel 1028, and bottom wall 934 includes bottom panel 1034 and glue panel 1022. Container 900 also includes opposing side walls in the shipping configuration (not shown) similar to side walls 246 and 248 of container 200. In the example embodiment, the first side wall includes second front side panel 1062, first rear side panel 1068, second top side panel 1096, and first bottom side panel 1102, and the second side wall includes first front side panel 1060, second rear side panel 1070, first top side panel 1094, and second bottom side panel 1104. End walls 924 and 932, top wall 928, bottom wall 934, and the side walls cooperate to define a cavity 952 of container 900.

In the example embodiment, container 900 is converted from the shipping configuration to display configuration 912 by operating opening mechanism 1160 such that at least a portion of glue panel 1022 remains adhered to bottom wall 934 while an edge of first end panel 1024 defined proximate fold line 1042 separates from bottom wall 934, and pulling top portion 902 up and back from display portion 904, for example by gripping access region 1150, such that top wall 928 separates from back wall 932 along perforated fold line 1048 and removable regions 1075 each separate from their respective side panels along respective side perforation lines 1077. Panels 1024, 1028, 1094, and 1096, portions 1075 of panels 1068 and 1070, and side panels 1060 and 1062 excepting portions 1075 thereof, define removable top portion 902 of container 900. Similarly, panels 1032, 1034, 1102, and 1104, portions 1075 of panels 1060 and 1062, and side panels 1068 and 1070 excepting portions 1075 thereof, form display portion 204. In some embodiments, side panels 1068 and 1070 having removable portions 1075 coupled to side panels 1096 and 1094, and side panels 1060 and 1062 having removable portions 1075 coupled to side panels 1104 and 1102, facilitates at least one of forming the container in the shipping configuration by a high-speed machine, improved enclosure of the cavity, and/or improved stability of the container in the shipping configuration.

In contrast to container 200 in display configuration 212 as shown in FIG. 3, in which container 200 is in the second orientation with bottom panel 34 on bottom for placement on a shelf, container 900 in display configuration 912 remains in the first orientation with second end panel 1032 on bottom for placement on a shelf. Thus, in some embodiments, and in contrast to the example embodiment of container 200 as described above, blank 1010 facilitates each of filling the partially formed container with a product, storing the container, shipping the container, and displaying the display portion of the container while the container is in a single, first orientation, in which second end wall 932 defines the bottom of container 900 and first end wall 924 defines the top of container 900. In other words, blank 1010 facilitates each of packing a product, such as but not limited to cans, into partially formed container 900, shipping, storing, and displaying the product in display portion 904 of container 900, in a single orientation. In alternative embodiments, container 900 formed from blank 1010 is placed in any suitable orientation for any of respectively filling the partially formed container with a product, storing the container, shipping the container, and displaying the display portion of the container.

In the example embodiment, as with container 200, in the first orientation, top panel 1028, bottom panel 1034, and side panels 1094, 1096, 1102, and 1104 each extend from the bottom to the top of container 900 and are oriented with corrugation direction 1190 in a vertical direction, facilitating an improved stacking strength of container 900. In addition, in some such embodiments, side panels 1094, 1096, 1102, and 1104 are positioned interiorly with respect to side panels 1060, 1062, 1068, and 1070, such that side panels 1094, 1096, 1102, and 1104 are positioned to directly bear weight placed on the top of container 900 and transmit the weight directly to the bottom of container 900, again facilitating an improved stacking strength of container 900. Alternatively or additionally, although top portion 902 is easily removable as described herein, a face of each of top panel 1028, bottom panel 1034, and side panels 1094, 1096, 1102, and 1104 is devoid of perforation lines or other lines of weakness extending therethrough, further facilitating an improved stacking strength of container 900. In other words, a perforation line extends at most along an end or side edge of any of top panel 1028, bottom panel 1034, and side panels 1094, 1096, 1102, and 1104, rather than into or through an interior face of top panel 1028, bottom panel 1034, and side panels 1094, 1096, 1102, and 1104. Moreover, in certain embodiments, front panel 1024 and rear panel 1032 also are devoid of perforation lines or other lines of weakness extending therethrough, further facilitating a stability of alignment of the walls of container 900 in the shipping configuration and, thus, an improved stacking strength of container 900. In alternative embodiments, at least one of top panel 1028, bottom panel 1034, and side panels 1094, 1096, 1102, and 1104 extends other than from the bottom to the top of container 900 and/or at least one of side panels 1094, 1096, 1102, and 1104 are positioned exteriorly with respect to side panels 1060, 1062, 1068, and 1070.

Figure 11:
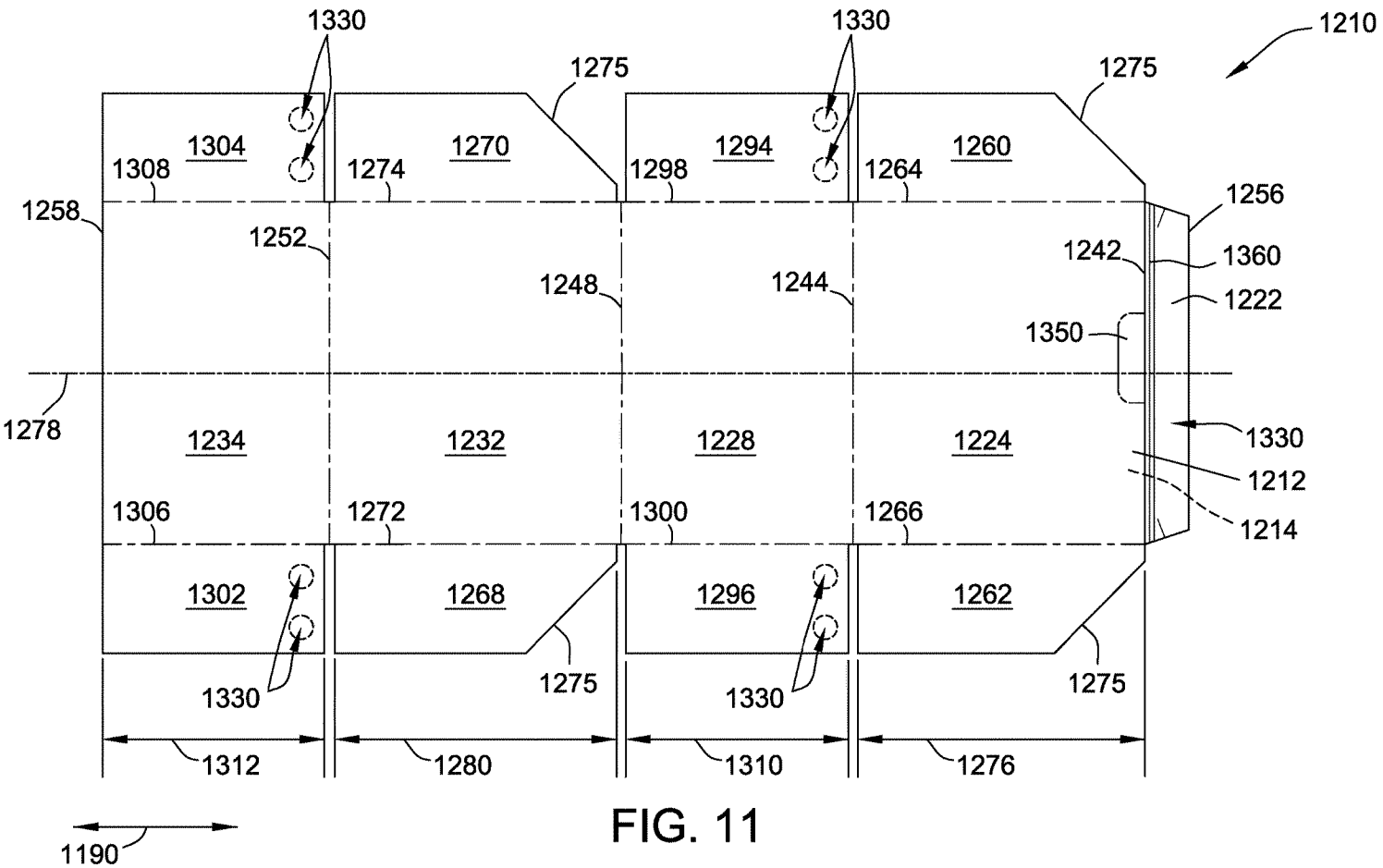
FIG. 11 is a top plan view of another example embodiment of a blank of sheet material.

FIG. 11 is a top plan view of another example embodiment of a blank 1210 of sheet material. Blank 1210 is substantially similar to blank 10' (shown in FIG. 4) and can be used to form a container (not shown) substantially similar to container 900. Unlike blank 10', blank 1210 includes notches 1275 on first front side panel 1260, second front side panel 1262, first rear side panel 1268, and second rear side panel 1270. Similarly to blank 1010, in some embodiments, blank 1210 also facilitates forming a container that enables both packing a product, such as but not limited to cans, into a partially formed container, and displaying the product in a display configuration of the container, in a single orientation that facilitates improved stacking strength.

The above-described embodiments provide containers convertible from a shipping configuration to a display configuration. In the display configuration, consumer viewing and access is unobstructed. In the shipping configuration, a face of each panel used to form two sets of opposing side walls is devoid of perforation lines or other lines of weakness extending therethrough, such that a stacking strength of the container is improved. Moreover, in some embodiments, a face of each panel used to form a third set of opposing walls also is devoid of perforation lines or other lines of weakness extending therethrough, such that a stacking strength of the container is further improved. In some embodiments, the container is easily convertible from the shipping configuration to the display configuration solely by operating an opening mechanism that at least partially separates a glue panel from a front panel, and separating along an edge perforation line, thus unsecuring the front panel, the top wall, the front side panel of each side wall, and the top side panel of each side wall from the bottom wall, the rear wall, the rear side panel of each side wall, and the bottom side panel of side wall. In certain embodiments, the rear side panel of each side wall also is secured to the top side panel in the shipping configuration, and additional rear side perforation lines enable removal of the secured portion of the rear side panel.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, the methods may also be used in combination with other containers and methods, and are not limited to practice with only the containers and methods as described herein. Rather, the example embodiments can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to illustrate the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank for forming a container convertible from a shipping configuration to a display configuration, the blank comprising:

a glue panel, a front panel, a top panel, a rear panel, and a bottom panel coupled together in series by a plurality of generally parallel fold lines, said glue panel comprising an opening mechanism and configured to couple in face-to-face relationship to said bottom panel when the container is formed;

a pair of top side panels extending from opposing side edges of said top panel; and a pair of bottom side panels extending from opposing side edges of said bottom panel, wherein an edge perforation line extends along an edge between said top panel and said rear panel, and wherein a face of each of said top panel, said bottom panel, and said pairs of side panels is devoid of perforation lines extending therethrough.

2. The blank in accordance with claim 1, wherein said glue panel is configured to couple to an exterior surface of said bottom panel, such that said opening mechanism is accessible from an outside of the container when the container is formed.

3. The blank in accordance with claim 1, wherein a width of each side panel of said pairs of side panels is substantially equal to a width of said top panel.

4. The blank in accordance with claim 1, further comprising:

a pair of front side panels extending from opposing edges of said front panel; and a pair of rear side panels extending from opposing edges of said rear panel.

5. The blank in accordance with claim 4, wherein each of said pair of front side panels is configured to couple to one of said pair of top side panels at a respective first glue region, and each of said pair of rear side panels is configured to couple to one of said pair of bottom side panels at a respective second glue region, when the container is formed.

6. The blank in accordance with claim 4, wherein said front panel, said top panel, said pair of front side panels, and said pair of top side panels are configured to be secured to said bottom panel, said rear panel, said rear side panels, and said pair of bottom side panels solely along said opening mechanism and said edge perforation line when the container is formed.

7. The blank in accordance with claim 4, wherein at least one of said rear side panels and said front side panels includes a removable region separable from a remainder of said at least one side panel along a respective side perforation line, each said removable region is configured to couple to a corresponding one of said top side panels and said bottom side panels when the container is formed, wherein said front panel, said top panel, said front side panels, and said top side panels are configured to be secured to said bottom panel, said rear panel, said rear side panels, and said bottom side panels solely along said opening mechanism, said edge perforation line, and each said side perforation line when the container is formed.

8. The blank in accordance with claim 1, further comprising a retaining panel coupled in series to said bottom panel, said retaining panel configured to align with said front panel in a substantially face-to-face relationship when the container is formed.

9. A container convertible from a shipping configuration to a display configuration, said container formed from a blank, said container comprising:

opposing front and rear walls, and opposing top and bottom walls perpendicular to said opposing front and rear walls, said bottom wall including a glue panel adjacent said front wall, said glue panel comprising an opening mechanism; and a pair of opposing side walls orthogonal to said front and rear walls and said top and bottom walls, each of said side walls comprising a top side panel emanating from said top wall and a bottom side panel emanating from said bottom wall, wherein an edge perforation line extends along an edge between said top wall and said rear wall, and wherein a face of each of said top wall, said bottom wall, said top side panels, and said bottom side panels is devoid of perforation lines extending therethrough.

10. The container in accordance with claim 9, wherein said glue panel is coupled to an exterior surface of said bottom wall, such that said opening mechanism is accessible from an outside of said container.

11. The container in accordance with claim 9, wherein a width of each panel of said top side panels and said bottom side panels is substantially equal to a width of said top wall.

12. The container in accordance with claim 9, wherein each said side wall further comprises:

a front side panel emanating from said front wall; and a rear side panel emanating from said rear wall.

13. The container in accordance with claim 12, wherein said front side panel is coupled to said top side panel at a respective first glue region, and said rear side panel is coupled to said bottom side panel at a respective second glue region.

14. The container in accordance with claim 12, wherein said front wall comprises a front panel emanating from said top wall, and wherein said front panel, said top wall, said front side panel of each said side wall, and said top side panel of each said side wall are secured to said bottom wall, said rear wall, said rear side panel of each said side wall, and said bottom side panel of each said side wall solely along said opening mechanism and said edge perforation line.

15. The container in accordance with claim 12, wherein said front wall comprises a front panel emanating from said top wall, and wherein at least one of said rear side panels and said front side panels includes a removable region separable from a remainder of said at least one side panel along a respective side perforation line, each said removable region is coupled to a corresponding one of said top side panels and said bottom side panels, wherein said front panel, said top wall, said front side panels, and said top side panels are secured to said bottom wall, said rear wall, said rear side panels, and said bottom side panels solely along said opening mechanism, said edge perforation line, and each said side perforation line.

16. The container in accordance with claim 9, wherein said front wall comprises a front panel emanating from said top wall and a retaining panel emanating from said bottom wall, said retaining panel is in a substantially face-to-face relationship with said front panel.

17. A method for forming a container convertible from a shipping configuration to a display configuration from a blank, said method comprising:

rotating a series of panels of the blank including a glue panel, a front panel, a top panel, a rear panel, and a bottom panel about a plurality of generally parallel fold lines, and coupling the glue panel in face-to-face relationship to the bottom panel, to form a front wall, a top wall, a rear wall, and a bottom wall of the container, wherein the glue panel includes an opening mechanism; and forming a pair of opposing side walls, wherein forming the side walls comprises rotating a pair of top side panels and a pair of bottom side panels into orthogonal relationship with the front wall, the top wall, the rear wall, and the bottom wall, wherein the top side panels extend from opposing side edges of the top panel and the bottom side panels extend from opposing side edges of the bottom panel, wherein an edge perforation line extends along an edge between the top panel and the rear panel, and wherein a face of each of the top panel, the bottom panel, and the pairs of side panels is devoid of perforation lines extending therethrough.

18. The method in accordance with claim 17, wherein the blank further includes a pair of front side panels extending from opposing side edges of the front panel and a pair of rear side panels extending from opposing side edges of the rear panel, said forming the side walls further comprises:

coupling each of the pair of front side panels to one of the pair of top side panels at a respective first glue region; and coupling each of the pair of rear side panels to one of the pair of bottom side panels at a respective second glue region.

19. The method in accordance with claim 18, further comprising unsecuring the front panel, the top wall, the front side panel of each side wall, and the top side panel of each side wall from the bottom wall, the rear wall, the rear side panel of each side wall, and the bottom side panel of each side wall solely by operating the opening mechanism and separating the edge perforation line, to convert the container into the display configuration.

20. The method in accordance with claim 18, wherein at least one of the rear side panels and the front side panels includes a removable region separable from a remainder of the at least one side panel along a respective side perforation line, wherein said forming the side walls further comprises coupling each removable region to a corresponding one of the top side panels and bottom side panels to further form the pair of opposing side walls, and wherein said method further comprises unsecuring the front panel, the top wall, the front side panel of each side wall, and the top side panel of each side wall from the bottom wall, the rear wall, the rear side panel of each side wall, and the bottom side panel of each side wall solely by operating the opening mechanism, separating the edge perforation line, and separating each of the side perforation lines, to convert the container into the display configuration.

21. The method in accordance with claim 17, wherein the blank further includes a retaining panel coupled in series to the bottom panel, and rotating the series of panels further comprises positioning the retaining panel in a substantially face-to-face relationship with the front panel.

* * * * *